United States Patent [19]

Beaumond

[11] 4,454,185

[45] Jun. 12, 1984

[54] TRIDIMENSIONAL METAL MESHWORK AS REINFORCEMENT FOR BUILDING PANELS AND A METHOD FOR THEIR MANUFACTURE

[76] Inventor: Jean-J. Beaumond, La Levratte 18, 1260 Nyon, Switzerland

[21] Appl. No.: 399,104

[22] Filed: Jul. 16, 1982

[30] Foreign Application Priority Data

Jul. 28, 1981 [CH] Switzerland ..... 4893/81
Sep. 30, 1981 [CH] Switzerland ..... 6300/81

[51] Int. Cl.[3] ..... B32B 7/00

[52] U.S. Cl. ..... 428/121; 428/124; 428/135; 428/137; 428/223; 428/247; 428/255; 428/256; 428/257

[58] Field of Search ..... 428/121, 124, 137, 138, 428/222, 223, 246, 247, 256, 116, 255, 257, 135

[56] References Cited

FOREIGN PATENT DOCUMENTS 2843324 6/1979 Fed. Rep. of Germany ..... 428/223

*Primary Examiner*—James J. Bell
*Attorney, Agent, or Firm*—Ladas & Parry

[57] ABSTRACT

The reinforcement comprises two layers of netting A1 and A2 formed by lengthwise oriented parallel wires (12*a*, 12*b*, . . . 13*a*, 13*b*, . . . ) and by crosswise oriented wires 8*a*, 8*b*, . . . 9*a*, 9*b*, . . . 10*a*, 10*b*, . . . 11*a*, 11*b*, . . . ); the meshes they form are square or rectangular in shape. Lengths of spacing wire (1, 2, 3) having the shape of zig-zags are connected obliquely to the two layers of netting. The spacing wires (1, 2, 3) are welded to the lengthwise oriented wires (12*b*, 12*c*, . . . 13*b*, 13*c* . . . ) and to the crosswise oriented wires (8*a*, 8*b* . . . 10*a*, 10*b*, . . . ) at their crossings.

13 Claims, 20 Drawing Figures

TRIDIMENSIONAL METAL MESHWORK AS REINFORCEMENT FOR BUILDING PANELS AND A METHOD FOR THEIR MANUFACTURE

Tridimensional metal meshworks have already been proposed for use as reinforcement in building panels. Such reinforcements are assembled by welding wires together to form two parallel layers of netting with square or rectangular meshes. The two nettings are held together by welding oblique spacing wires. Swiss Patent Application Nos. 8511/80 and 1309/81 describe such meshworks. However, the spacing wires are short segments which have to be welded one by one to the two layers of the netting. Furthermore, they cannot be welded at the crossings of the nettings, but at some distance, which complicates the work and reduces the mechanical resistance of the meshwork thus obtained.

The purpose of the present invention is to provide a tridimensional metal meshwork or the type described above, but which would not have the drawbacks mentioned.

The tridimensional metal meshwork for use as reinforcement for building panels of the present invention is in accordance with the appended claims 1-12.

A method is also described for the manufacture of such a meshwork.

The drawings provide examples of several embodiments of the present invention and illustrate their manufacture.

FIG. 1 is a perspective view of three spacing wires at the first stage of manufacture of a meshwork according to the first embodiment of the present invention.

FIG. 1*a* is an end view of the spacing wires illustrated on FIG. 1.

FIG. 2 is a perspective view of the first embodiment of the present invention, at the second stage of manufacture.

FIG. 2*a* is an end view corresponding to FIG. 2.

FIG. 3 is a perspective view similar to FIG. 1 and 2 and shows a portion of the first embodiment of the present invention, when finished.

FIG. 3*a* is an end view corresponding to FIG. 3.

Figure 1A:
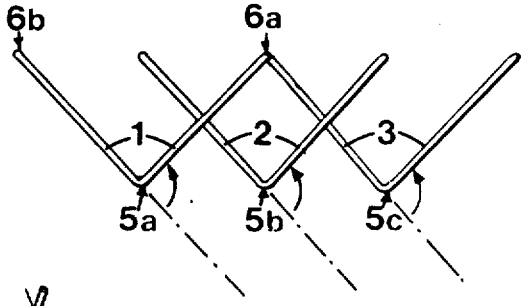
Figure 1:
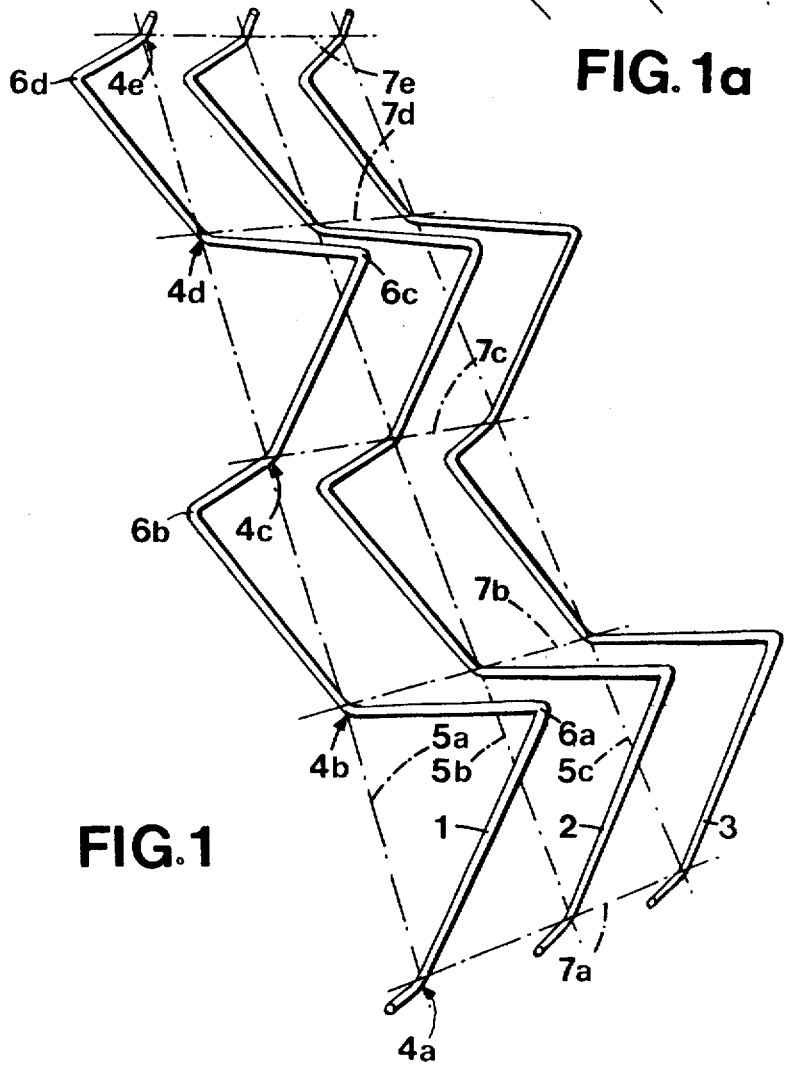

FIG. 1 shows three spacing wires 1, 2, 3, which have been shaped as will be described, placed at a defined distance one from the other. It can be seen that the three wires are identical in their shape: therefore, only wire 1 will be described. This wire forms a zig-zag with a series of elbows 4*a*, 4*b*, 4*c*, 4*d*, 4*e*, . . . located on a straight line 5*a*. The same elbows of the wires 2 and 3 are located respectively on the lines 5*b* and 5*c*, which are parallel to 5*a*. The section of wire located between 4*a* and 4*b* has an elbow 6*a*, the section between 4*c* and 4*d* an elbow 6*c*, and the section between 4*d* and 4*e* an elbow 6*d*.

The elbows 4*a*, 6*a* and 4*b* lie in a plane which is inclined rightwards on the plane defined by 5*a*, 5*b* and 5*c*, whereas the elbows 4*b*, 6*b* and 6*c* lie in a plane which is inclined leftwards.

The following elbows 4*c*, 6*c*, 4*d* form a triangle identical to the first triangle 4*a*, 6*a* 4*b* and the elbows 4*d*, 6*d*, 4*e* form a triangle identical to the second triangle 4*b*, 6*b*, 4*c*.

FIG. 1*a* shows that the triangles alternately inclined rightwards and leftwards have the same inclination on the plane defined by 5*a*, 5*b*, 5*c*.

FIG. 1 shows that the elbows 4*a*, 4*b* . . . 4*e* on wire 1 and their equivalents on wire 2 and 3 are located on straight lines 7*a*, 7*b*, . . . 7*e* which are at right angles with 5*a*, 5*b*, 5*c*.

The wires 1, 2, 3 of FIG. 1 and 1*a* are shaped by first forming a zig-zag, the elbows of which are 6*a*, 6*b*, 6*c*, 6*d* in the case of wire 1, then by bending the zig-zags around the lines 5*a*, 5*b*, 5*c* in the direction indicated by the arrows on FIG. 1*a*.

The wires 1, 2, 3 thus shaped are positioned as shown on FIG. 1. The straight wires 8*a*, 8*b*, 8*c*, 8*d*, 8*e* are then positioned in the lower elbows 4*a*, 4*b*, 4*c*, 4*d*, 4*e* respectively of wire 1 and in the corresponding elbows of wire 2 and 3 as shown on FIG. 2. At the same time are positioned the intermediate wires 9*a*, 9*b* 9*c*, 9*d*, which are parallel to the preceding wires and situated in the same place.

Then or simultaneously, another set of wires 10*a*, 10*b*, 10*c* 10*d* identical to 8*a*, 8*b*, 8*c* . . . is placed inside the upper elbows 6*a*, 6*b*, 6*c*, 6*d* respectively of wire 1 and in the corresponding elbows of wire 2 and 3. At the same time are positioned the intermediate wires 11*a*, 11*b*, 11*c*, 11*d*, which are parallel to the preceding wires and situated in the same plane. As will be seen further, the wires 8*a*, 8*b* . . . and 9*a*, 9*b* . . . form the weft of one of the nettings when the meshwork is completed. In the same way, the wires 10*a*, 10*b* . . . and 11*a*, 11*b* . . . form the weft of the other netting.

Figure 2A:
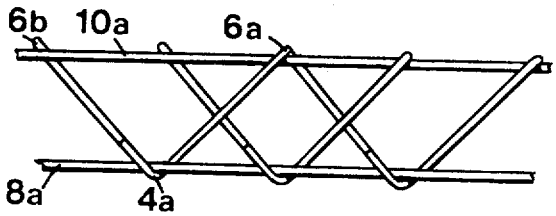
Figure 2:
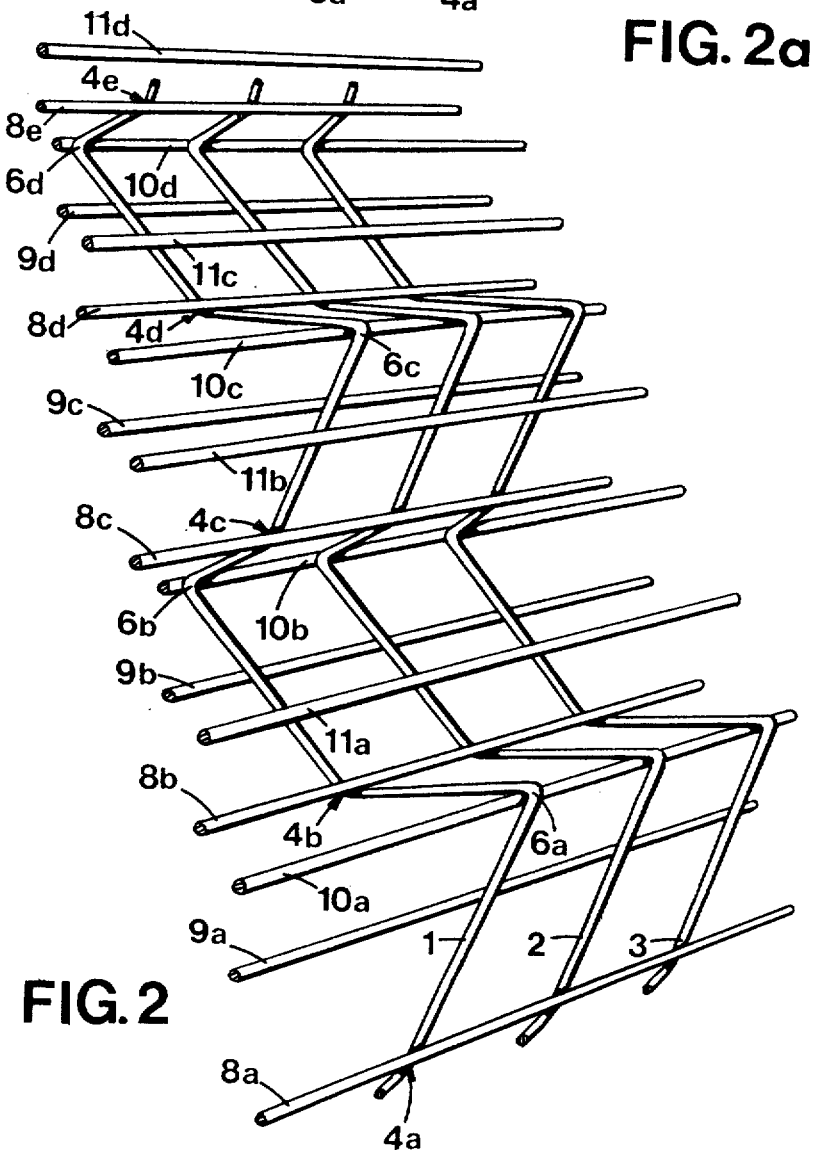
Figure 3A:
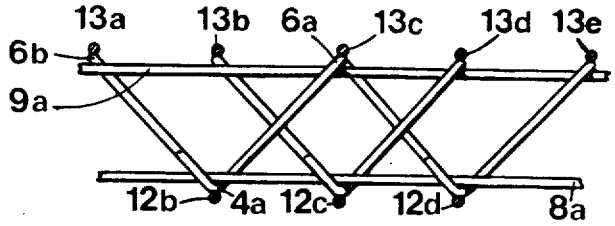
Figure 3:
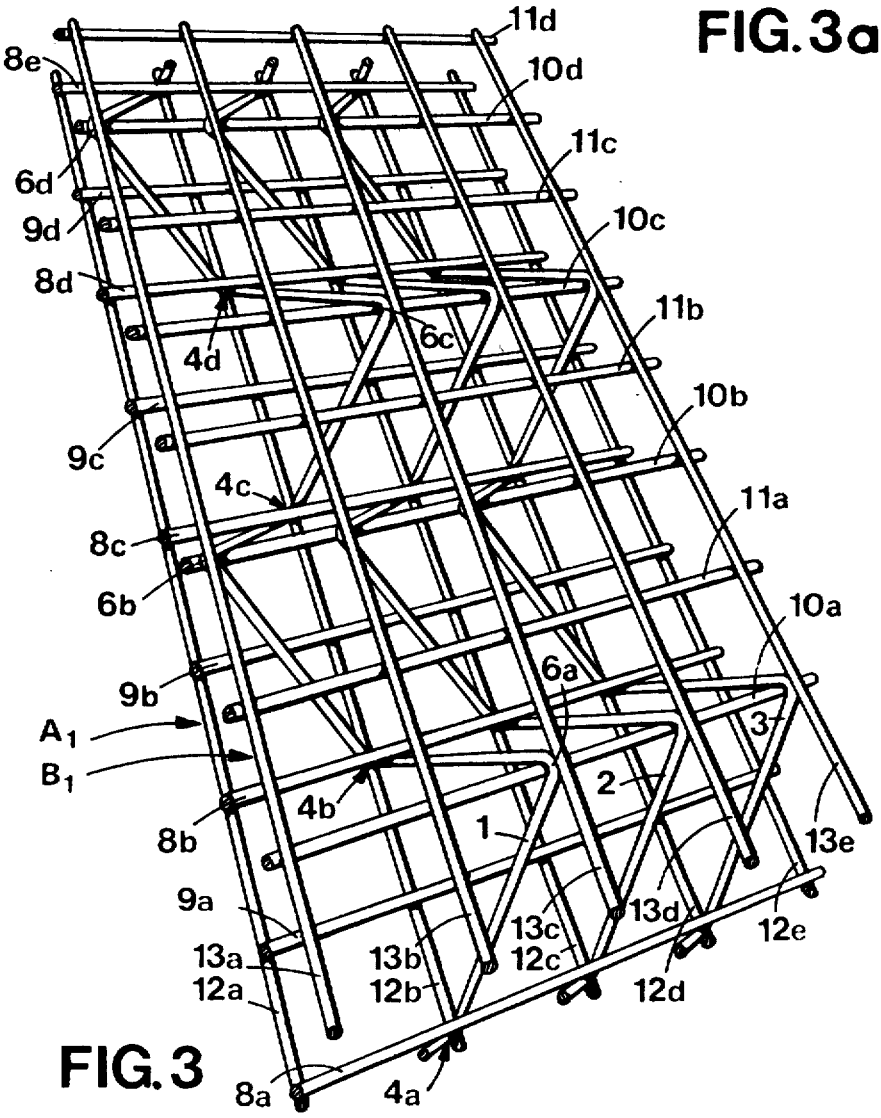

The different components shown in FIG. 2 are held in position by means not shown on the drawings, while the wires 12*a*, 12*b*, . . . 12*e* are positioned as shown on FIG. 3, thus completing the lower netting. 12*a*, 12*b*, . . . 12*e* are parallel and situated in the same plane. In the same way, the upper netting is completed by positioning the wires 13*a*, 13*b*, . . . 13*e*. The wires 13*a*, 13*b*, . . . 13*e* are parallel and situated in a same plane which is parallel to the plane defined by 12a, 12b . . . 12e.

The lower netting is assembled by positioning the wire 12b against the elbows 4a, 4b, 4c, 4d of wire 1 from underneath. The wires 12c and 12d are positioned in the same way against the corresponding elbows of wire 2 and 3 respectively.

The upper wires 13a, 13b . . . 13e are arranged in such a manner that the wire 13a is positioned from above against the upper left elbows 6b, 6d of wire 1, the wire 13b from above against the upper left elbow of wire 2, the wire 13c from above against the upper right elbows 6a, 6c of wire 1, and the wire 13d from above against the right upper elbows of wire 2.

All the wires of FIG. 3 are electrically welded at the crossings. At such crossings as those of wire 9a with wires 12a, 12b or of wire 9b with wires 12a, 12b, only the crossing wires are welded together, whereas at such crossings as, for instance, those of wire 8a with wire 12b and 12c or 8b with 12b and 12c, the crossing wires are welded together with the spacing wires 1, 2.

FIG. 3 shows a portion of the first embodiment of the present invention when completed. The meshwork comprises a lower netting A1 with square or rectangular meshes, an upper netting B1 identical to A1, with all its meshes facing those of netting A1 and spacing wires 1, 2, 3, . . . the straight segments of which are oriented obliquely to the wires of the netting.

In this example, the wires 12a, 12b, 12c, . . . and 13a, 13b, 13c form the warp, while the wires 8a, 9a, 8b, 9b, 8c, 9c . . . and 10a, 11a, 10b, 11b, 10c, 11c, . . . form the weft of the nettings A1 and B1. It should also be noted that the spacing wires have general orientation which is parallel to the warp of the nettings.

One can appreciate on FIG. 2 and 3 the very good quality of the spacing system of the present invention.

The metal meshwork can be assembled otherwise than described previously. The lower wires 12a, 12b . . . 12e can be positioned first, than the spacing wires 1, 2, 3, 4, . . ., then the wires 8a, 8b, 9a, 9b, . . . 10a, 10b, . . . and 11a, 11b, . . . as described and finally the wires 13a, 13b, 13c, . . . which come on top. The wires are then welded at the crossings.

Quite obviously, the spacing wires can be arranged in a crosswise direction instead of a lengthwise direction. In this case, the wires 12a, 12b, 12c, . . . and 13a, 13b, 13c, . . . form the weft and the wires 8a, 8b, 8c, . . . 9a, 9b, 9c . . . 10a, 10b, 10c, . . . and 11a, 11b, 11c form the warp.

Figure 4:
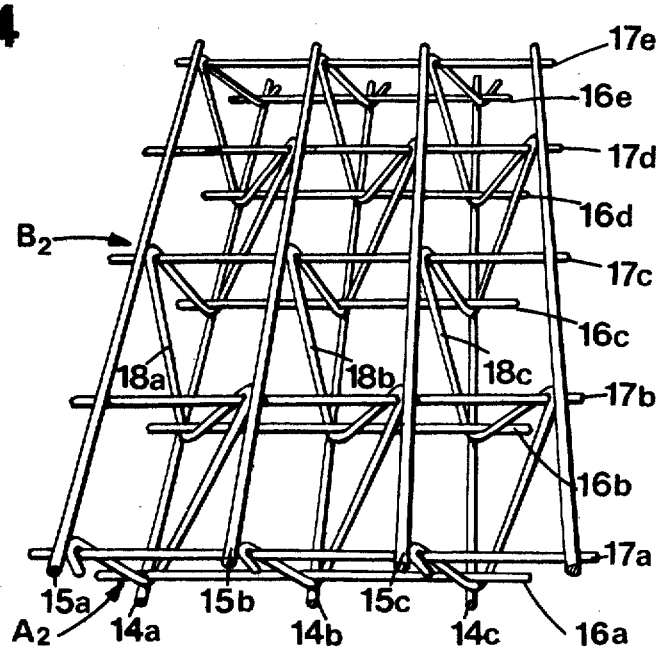
FIG. 4 is a perspective view similar to that of FIG. 3, but is related to the second embodiment of the present invention.

In the embodiment of FIG. 4, two identical nettings A2 and B2 with square or rectangular meshes are formed by lengthwise wires 14a, 14b, 14c (lower netting A 2) and 15a, 15b, 15c (upper netting B2) and by crosswise wires 16a, 16b, . . . 16e (netting A2) and 17a, 17b, . . . 17e (netting B2). The meshwork is completed by the spacing wires 18a, 18b, 18c quite similar to the spacing wires 1, 2, 3 . . . of FIG. 3. When compared with the previous example, one of the nettings in the embodiment of FIG. 4 has been shifted crosswise by half a mesh. The spacing wire 18a passes between the wire 15a and 17a at their crossing, then between the wires 14a and 16a also at their crossing, then between the wires 15b and 17b, then between the wires 16b and 14a. The neighbouring wire 18b passes between the wires 15b and 17a at their crossing, then between the wires 14b and 16a also at their crossing, then between the wires 15c and 17b. At each crossing of both nettings, a spacing wire therefore meets both the crosswise and the lengthwise oriented wires. At each crossing, the three wires are welded together electrically. In the embodiment of FIG. 3, in half the crossings a spacing wire is welded with both the lengthwise and the crosswise oriented wires. In the other half, barely the two wires of the netting are welded together.

Figure 5:
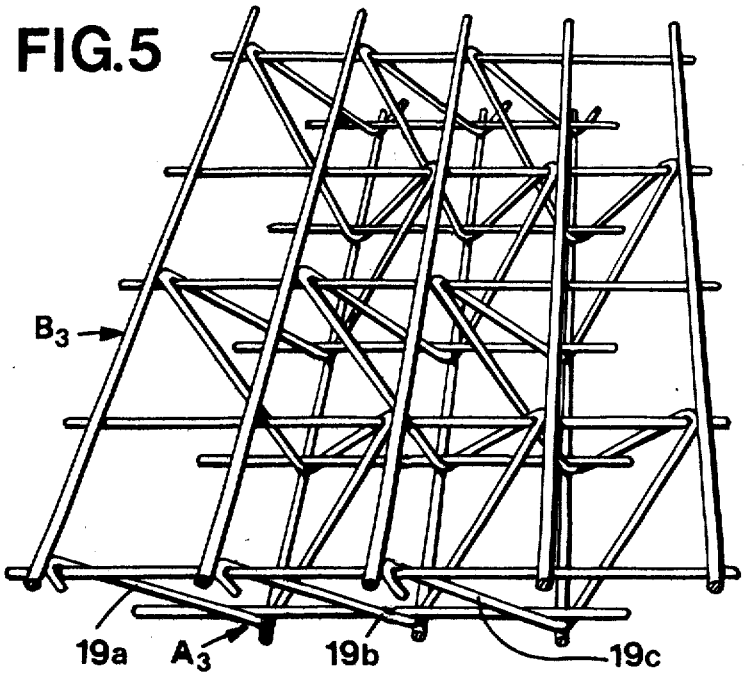
FIG. 5 is a perspective view similar to that of FIG. 4, but is related to another embodiment of the present invention.

In the embodiment illustrated on FIG. 5, the meshwork comprises a lower netting A3 with square (or rectangular) meshes, an upper netting B3 identical to A3 with its meshes facing those of B3 as in FIG. 3 and spacing wires similar in shape to the spacing wires 18a, 18b, 18c of FIG. 4, but which are welded to two wires which are separated by a third wire, instead of being welded, as in FIG. 4 to two contiguous wires. This results in a sort of interpenetration of two adjacent spacing wires, as shown on FIG. 5. In this embodiment too, there is a spacing wire welded at each crossing.

In the preceding examples illustrated on FIG. 1 to 5, the crosswise oriented wires are welded on the inside of the elbows of the spacing wires, whereas the lengthwise oriented wires are welded on the outside. It was found that the positioning of the crosswise wires was rather difficult. This difficulty is eliminated in the following embodiments, which also bring other advantages in the manufacture of meshworks of the type considered here.

Figure 9:
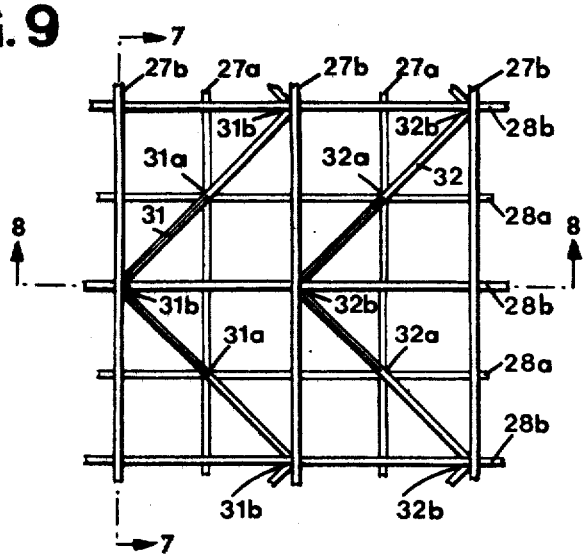
FIG. 9 is a plan-view of the embodiment illustrated on FIG. 6.

In the embodiment illustrated in FIG. 6 to 9, two identical nettings A6 and B6 with square or rectangular meshes are formed by lengthwise wires 27a, 27b and by crosswise wires 28a, 28b. When compared with the embodiment of FIG. 3, one of the two nettings has been shifted both lengthwise and crosswise by half a mesh (FIG. 9). The shift could be different from that selected here. The reasons of this shift will be explained further.

Figure 6:
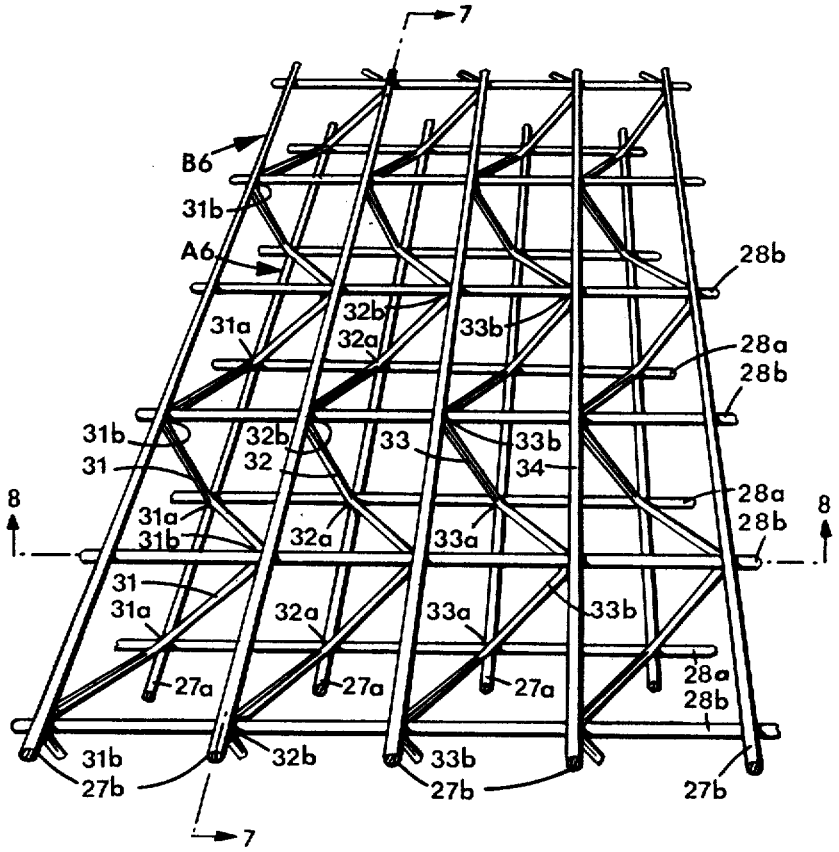
FIG. 6 is a perspective view similar to that of FIG. 5, but is related to another embodiment of the present invention.
Figure 7:
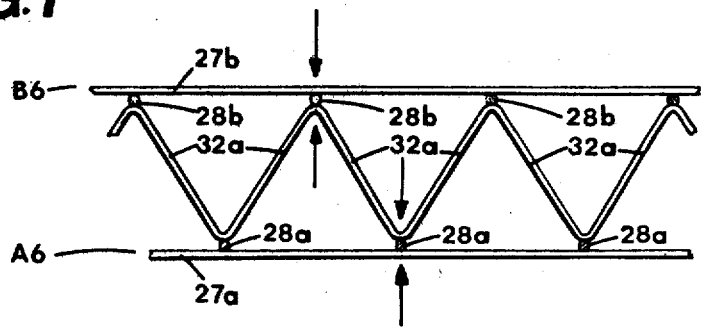
FIG. 7 is a view of cross-section 7—7 of FIG. 6 and 9.
Figure 8:
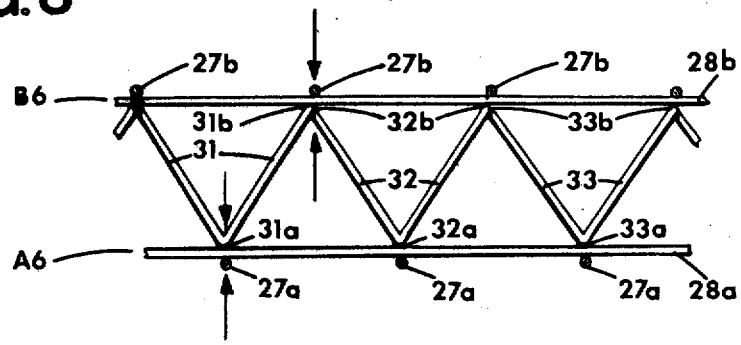
FIG. 8 is a view of cross-section 8—8 of FIG. 6 and 9.

The two nettings A6 and B6 are provided with spacing wires 31, 32, 33, 34, which form a zig-zag as shown on FIG. 6. These spacing wires have a general lengthwise orientation.

Each lower elbow 31a, 32a, 33a of the spacing wires is welded electrically to the crosswise wires 28a of the netting A6, which in turn are welded to the lengthwise wires 27a.

In the same way, each upper elbow 31b, 32b, 33b of the spacing wires is welded electrically to the crosswise wires 28b of the netting B6, which in turn are welded to the lengthwise wires 27b.

Figure 10:
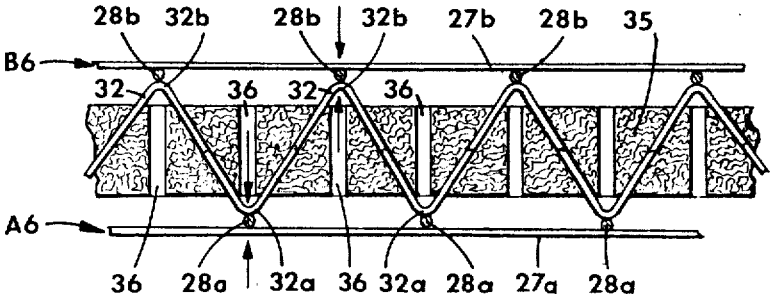
FIG. 10 is a view similar to that of FIG. 7, and illustrates a method of manufacture of the embodiment described in the FIG. 6 to 9.

Therefore, the spacing wires are entirely located with their elbows between the two nettings A6 and B6, which makes the assembling of the meshwork easier. This assembling is proceded with as follows. The spacing wires are appropriately positioned, and then embedded firmly in some injectable compound such as polyurethane foam 35, except for their elbows 32a and 32b (FIG. 10). The layer of the injected compound is provided with the holes 36.

The wires which are to form the nettings A6 and B6 are then positioned so that each crossing is abutting an elbow 32a, 32b. The three wires are welded together electrically, with the electrodes applied as indicated by the arrows on FIG. 10. The openings 36 are designed to allow the passage of a welding electrode.

It is because one of the nettings has been shifted lengthwise and crosswise (see FIG. 9) that the wires can be welded in the manner described. The position of the electrodes during the welding operation is also indicated on FIG. 7 and 8 by arrows.

Once the wires are welded together, the openings 36 can be obliterated by inserting cylindrical or slightly frustoconical plugs, preferably made of the same material as the rest of the layer 35.

The embodiment illustrated on FIG. 11 to 14 is particularly simple to assemble. This embodiment comprises two preformed nettings A7 and B7 with square or rectangular meshes and a preformed system of spacing wires C7. The spacing system C7 comprises wires having the shape of zig-zags and straight parallel wires welded crosswise to the zig-zags at their elbows. The spacing system C7 is shown on FIG. 13 and 14 and is made by the same method as illustrated on FIG. 1 and 1*a*. The relative position of the zig-zags is identical to that shown on FIG. 9. The three components A7, B7, C7 are assembled by bringing the elbows of the spacing system C7 against the crossings of the nettings A7 and B7 and welding the wires together.

Figure 16:
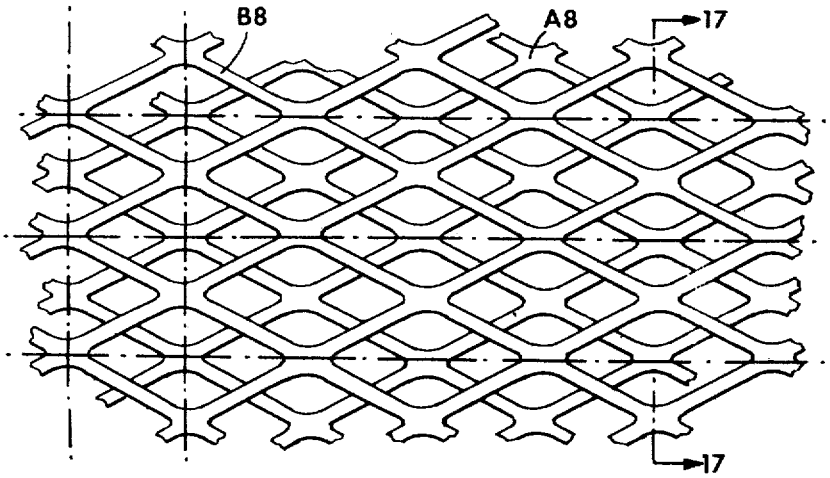
FIG. 16 is a plan-view of the last embodiment of the present invention. The spacing wires have been omitted to make the drawing easy to comprehend.
Figure 11:
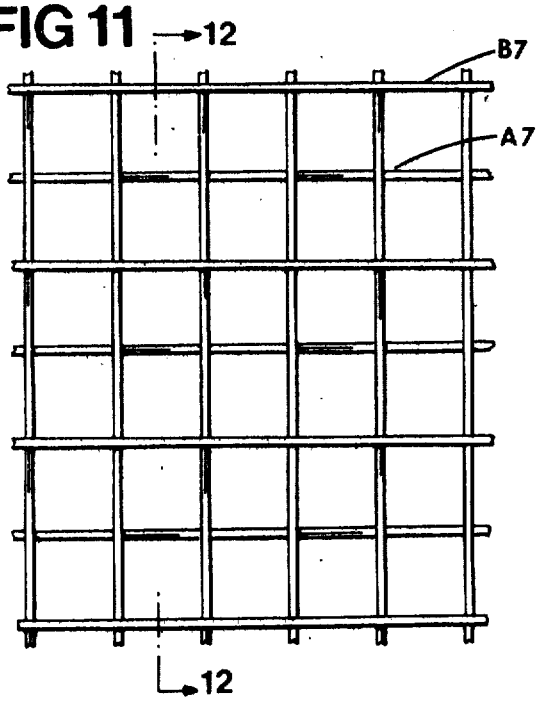
FIG. 11 is a plan view of another embodiment of the present invention, This drawing shows only the netting, the spacing wires have been omitted to make the drawing easy to comprehend.
Figure 12:
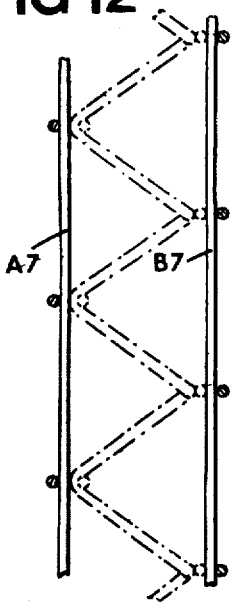
FIG. 12 is a view of cross-section 12—12 of FIG. 11.
Figure 13:
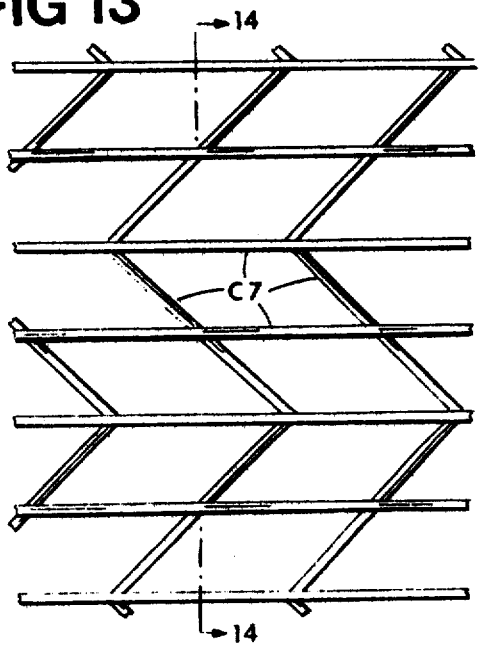
FIG. 13 is a plan-view of the spacing system of the embodiment described in FIG. 11 and 12.
Figure 14:
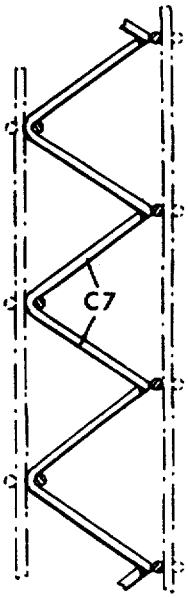
FIG. 14 is a view of cross-section 14—14 of FIG. 13, when the nettings (FIG. 11 and 12) and the spacing wires (FIG. 13) are assembled.
Figure 15:
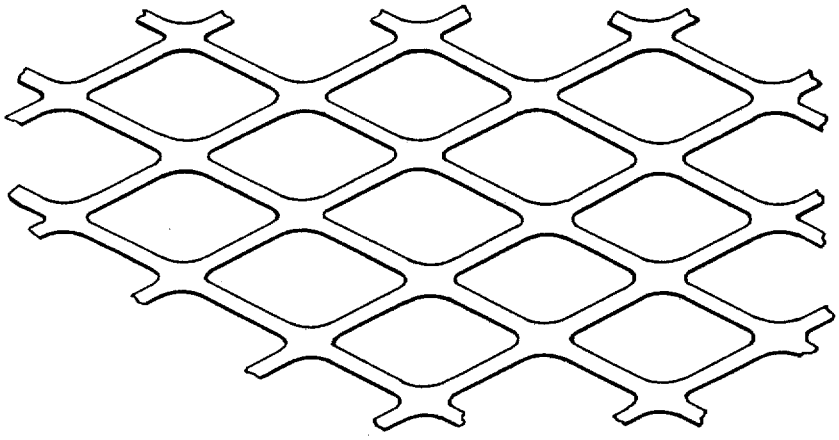
FIG. 15 is a top view of the netting used in the last embodiment of the present invention.
Figure 17:
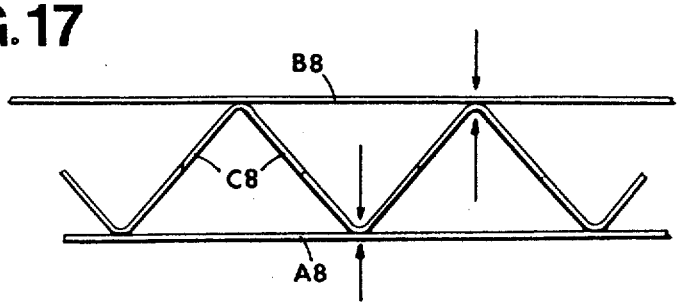
FIG. 17 is a view of cross-section 17—17 of FIG. 16.

The embodiment illustrated in FIG. 15 to 17 is similar to the embodiment illustrated in FIG. 11 and 14. It differs however in the following points. The nettings A8 and B8 are made from a metal sheet provided with diamond-shaped meshes (FIG. 15). One of the nettings has been shifted lengthwise and crosswise by preferably half a mesh (FIG. 16) in order to make the welding of the nettings A8 and B8 to the system of spacing wires C8 easier (FIG. 17). The spacing system C8 can belong to any of the types described previously. The welding electrodes have been represented on FIG. 17 by arrows. This drawing illustrates the manner in which C8 is welded to A8 and B8.

The dotted lines on FIG. 16 indicate the lengthwise direction on the netting. This is also the direction in which the netting is manufactured.

It will be noted, that the two embodiments illustrated in FIG. 11 to 14 and in FIG. 15 to 17 are particularly advantageous, since they enable the meshwork to be produced in a continuous process from three components easy to position correctly, which is important when an automated manufacture is considered.

The embodiment illustrated on FIG. 15 to 17 has another advantage, that when assembling the nettings A8, B8 and the spacing system C8, only two components are welded together instead of welding together three wires, as in all the other embodiments.

In the examples which have been described, the word wire was used to qualify the components from which the nettings and the spacing systems were constructed. The use of this word "wire" does not imply that the diameter is particularly small. Are considered as wires cold-drawn rods and wires of various diameters.

In the example which have been described, the spacing systems have a general lengthwise orientation. It is quite obvious, that such a spacing system could also be oriented crosswise: this would in fact simplify the manufacturing of the tridimensional meshwork, since spacing systems which have the same length as the netting is wide, would be easier to position.

I claim:

1. Tridimensional meshwork for building panels, comprising at least two parallel layers of netting and at least one obliquely oriented spacing system located in such manner that at least a significant portion of said spacing system is disposed between said parallel layers of netting, each unit of said spacing system is made of a single elongated member having a shape of a zig-zag which is disposed in tridimensional directions, alternate elbows of each spacing unit are situated in at least two different planes and fixedly attached to said nettings.

2. Tridimensional meshwork according to claim 1, wherein the entire spacing system is located between two layers of netting.

3. Tridimensional meshwork according to claim 1 or 2, wherein the nettings are made of elongated members oriented is such manner that these members forms meshes which are rectangular in a shape.

4. Tridimensional meshwork according to claim 1 or 2 wherein the spacing units have same orientation as the weft of the two nettings.

5. Tridimensional meshwork according to claim 1 or 2 wherein two layers of netting are positioned as preformed components.

6. Tridimensional meshwork according to claim 1 wherein one of the layers is shifted in relation to the other layer lengthwise, crosswise or both.

7. Tridimensional meshwork according to claim 1 or 2 wherein the spacing system is a preformed component bent as zig-zag.

8. Tridimensional meshwork according to claim 1 wherein two layers are made of metal sheets provided with diamond-shaped meshes.

9. Tridimensional meshwork according to claim 8 wherein one of the layers is shifted in relation to the other layer.

10. Tridimensional metal meshwork according to claim 1 which is made of metal components welded together.

11. Tridimensional meshwork according to claim 10, wherein every second crosswise oriented member is welded to both a lengthwise oriented member and an elbow of the spacing member, the remaining crosswise oriented members being only welded to the lengthwise oriented members.

12. Tridimensional meshwork according to claim 10 wherein every second lengthwise oriented member is welded to both a crosswise oriented member and to an elbow of the spacing member, the remaining lengthwise oriented member being only welded to the crosswise oriented members.

13. Tridimensional meshwork according to claim 1 or 6 wherein one of the layers of netting is shifted crosswise by half a mesh.

* * * * *